US009061176B2

(12) United States Patent
Nikkaran

(10) Patent No.: US 9,061,176 B2
(45) Date of Patent: Jun. 23, 2015

(54) EXERCISE APPARATUS

(71) Applicant: Gorgi Nikkaran, Greenvale, NY (US)

(72) Inventor: Gorgi Nikkaran, Greenvale, NY (US)

( * ) Notice: Subject to any disclaimer, the term of this patent is extended or adjusted under 35 U.S.C. 154(b) by 63 days.

(21) Appl. No.: 13/690,193

(22) Filed: Nov. 30, 2012

(65) Prior Publication Data

US 2014/0155229 A1 Jun. 5, 2014

(51) Int. Cl.

| | |
|---|---|
| ***A63B 21/062*** | (2006.01) |
| ***A63B 21/068*** | (2006.01) |
| ***A63B 1/00*** | (2006.01) |
| ***A63B 21/00*** | (2006.01) |
| ***A63B 21/16*** | (2006.01) |
| ***A63B 23/035*** | (2006.01) |

(52) U.S. Cl.

CPC ..... *A63B 21/068* (2013.01); *A63B 21/1419* (2013.01); *A63B 21/154* (2013.01); *A63B 21/1663* (2013.01); *A63B 23/03541* (2013.01)

(58) Field of Classification Search

CPC ..... A63B 21/00; A63B 21/06; A63B 21/068; A63B 21/08

USPC ..... 482/23, 38–40, 43, 92–96, 98–99

See application file for complete search history.

(56) References Cited

U.S. PATENT DOCUMENTS

| | | | | | |
|---|---|---|---|---|---|
| 864,188 | A | * | 8/1907 | Patterson | 482/96 |
| 1,374,697 | A | * | 4/1921 | Werndli | 482/95 |
| 2,183,265 | A | * | 12/1939 | Maloney | 482/95 |
| 2,716,027 | A | * | 8/1955 | Gehri | 482/131 |
| 3,118,441 | A | * | 1/1964 | Prosser | 601/23 |
| 3,937,461 | A | * | 2/1976 | Lew | 482/43 |
| 4,052,070 | A | * | 10/1977 | Lew | 482/96 |
| 4,079,933 | A | * | 3/1978 | Everroad | 482/140 |
| 4,109,907 | A | | 8/1978 | Zito | |
| 4,125,257 | A | * | 11/1978 | Lew | 482/43 |
| 4,431,184 | A | * | 2/1984 | Lew et al. | 482/43 |
| 5,048,825 | A | * | 9/1991 | Kelly | 482/94 |
| 5,176,602 | A | * | 1/1993 | Roberts | 482/131 |
| 5,360,384 | A | * | 11/1994 | Toensing | 482/43 |
| 5,403,253 | A | * | 4/1995 | Gaylord | 482/43 |
| 5,713,821 | A | * | 2/1998 | Nissen | 482/114 |
| 5,885,190 | A | | 3/1999 | Reiter | |
| 5,944,640 | A | | 8/1999 | Larsson | |
| 6,113,564 | A | * | 9/2000 | McGuire | 602/32 |
| 6,267,711 | B1 | * | 7/2001 | Hinds | 482/121 |
| 6,705,974 | B1 | * | 3/2004 | Tardif | 482/39 |
| 8,152,704 | B2 | * | 4/2012 | Brice et al. | 482/129 |

(Continued)

FOREIGN PATENT DOCUMENTS

| | | |
|---|---|---|
| CH | 279927 | 4/1952 |

*Primary Examiner* — Stephen Crow
*Assistant Examiner* — Garrett Atkinson
(74) *Attorney, Agent, or Firm* — Welsh Flaxman & Gitler LLC

(57) ABSTRACT

An exercise apparatus includes a mounting assembly and a pulley assembly coupled to the mounting assembly. The pulley assembly includes a first pulley and a second pulley. A first pulley cable is positioned about the first pulley for movement relative thereto and a second pulley cable is positioned about the second for movement relative thereto. The first pulley cable includes a first end and a second end and the second pulley cable includes a first end and a second end. A first handle is coupled to the first end of the first pulley cable and a second handle is coupled to the first end of the second pulley cable. A body engaging assembly is coupled to the both the second end of the first pulley cable and the second end of the second pulley cable.

12 Claims, 6 Drawing Sheets

(56) References Cited

U.S. PATENT DOCUMENTS

2007/0278464 A1* 12/2007 Constant ..... 254/1
2010/0292056 A1* 11/2010 Birch et al. ..... 482/129
2011/0166003 A1* 7/2011 Brice et al. ..... 482/131
2014/0005015 A1* 1/2014 Hester ..... 482/131

* cited by examiner

EXERCISE APPARATUS

BACKGROUND OF THE INVENTION

1. Field of the Invention

This invention relates to an exercising apparatus. More particularly, the invention relates to an exercise apparatus using the weight of the user as resistance in the performance of the exercise.

2. Description of the Related Art

A number of pulley-based exercise devices are known. The devices, however, exhibit a variety of shortcomings in both versatility and ease of use. As such, there remains a need for a pulley-based exercise device offering wide ranging versatility in the muscle groups that may be worked as well as an ease of use encouraging regular and effective exercise by the user. The present invention provides such an exercise device.

SUMMARY OF THE INVENTION

It is, therefore, an object of the present invention to provide an exercise apparatus including a mounting assembly and a pulley assembly coupled to the mounting assembly. The pulley assembly includes a first pulley and a second pulley. A first pulley cable is positioned about the first pulley for movement relative thereto and a second pulley cable is positioned about the second for movement relative thereto. The first pulley cable includes a first end and a second end and the second pulley cable includes a first end and a second end, A first handle is coupled to the first end of the first pulley cable and a second handle is coupled to the first end of the second pulley cable. A body engaging assembly is coupled to the both the second end of the first pulley cable and the second end of the second pulley cable.

It is also an object of the present invention to provide an exercise apparatus wherein the pulley assembly includes a support bar from which a coupling bar for releasably securing the pulley assembly to the mounting assembly extends, It is another object of the present invention to provide an exercise apparatus wherein the pulley assembly includes a first pulley and a second pulley extending from the support bar.

It is a further object of the present invention to provide an exercise apparatus wherein the support bar includes a first end and second end, and the first end of the support bar includes a first O-ring to which the first pulley is secured and a second O-ring to which the second pulley is secured.

It is also an object of the present invention to provide an exercise apparatus wherein the first pulley is releasably secured to the first O-ring and the second pulley is releasably secured to the second O-ring.

It is another object of the present invention to provide an exercise apparatus wherein the mounting assembly includes a first end and a second end, and wherein the first end of the mounting assembly includes an abutment member and the second end of the mounting assembly includes a releasable coupling member allowing for selective attachment of the pulley assembly to the mounting assembly.

It is a further object of the present invention to provide an exercise apparatus wherein the releasable coupling number of the mounting assembly is a carbineer.

It is also an object of the present invention to provide an exercise apparatus including an adjustable coupling strap securing the pulley assembly to the mounting assembly.

It is another object of the present invention to provide an exercise apparatus wherein the first handle is releasably coupled to the first end of the first pulley cable and the second handle is releasably coupled to the first end of the second pulley cable.

It is a further object of the present invention to provide an exercise apparatus wherein the body engaging assembly is a belt shaped and dimensioned for positioning about a waste of a user as he or she exercisers.

It is also an object of the present invention to provide an exercise apparatus wherein the belt includes an elongated body with an inner surface and an outer surface, as well as a first end and a second end. The respective first end of the elongated body and the second end of the elongated body are provided with mating fastening members allowing for releasable attachment of the belt about the waist of a user.

It is another object of the present invention to provide an exercise apparatus, wherein the belt includes first and second O-rings used in releasably securing the second ends of the first and second pulley cables to the elongated body.

It is a further object of the present invention to provide an exercise apparatus wherein the first and second O-rings are positioned along the outer surface of the elongated body.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
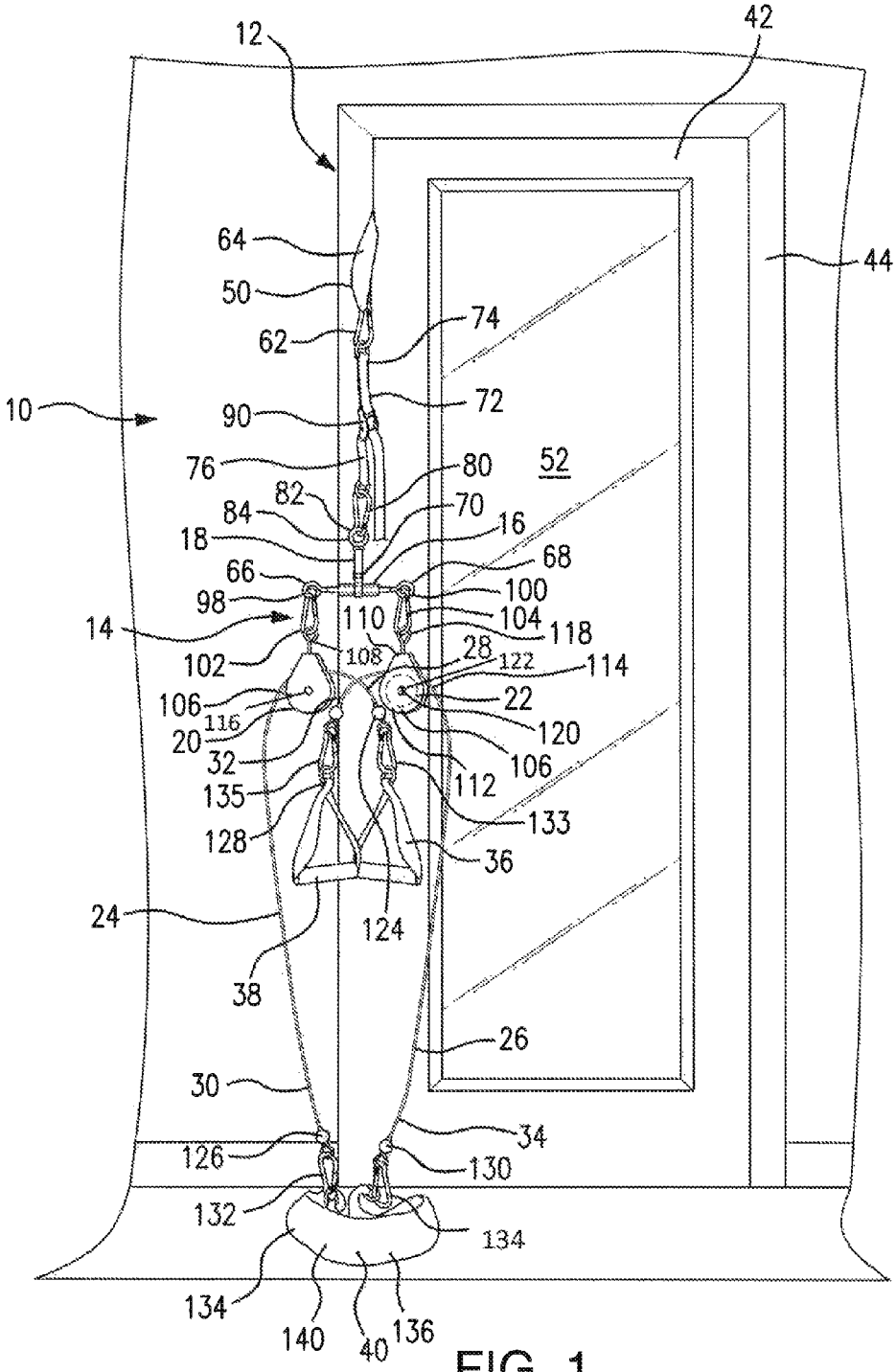
FIG. 1 is a perspective view of the exercise apparatus in accordance with the present invention.

The detailed embodiments of the present invention are disclosed herein. It should he understood, however, that the disclosed embodiments are merely exemplary of the invention, which may be embodied in various forms. Therefore, the details disclosed herein are not to he interpreted as limiting, but merely as a basis for teaching one skilled in the art how to make and/or use the invention.

Referring to the various figures, an exercise apparatus 10 using the weight of the individual exercising as a resistance source is disclosed. The exercise apparatus 10 includes a mounting assembly 12 and a pulley assembly 14 coupled to the mounting assembly 12. The pulley assembly 1.4 includes a support bar 16 from which a coupling bar 18 extends. The coupling bar 18 is used in releasably securing the pulley assembly 14 to the mounting assembly 12. The pulley assembly 14 also includes a first pulley 20 and a second pulley 22 extending from the support bar 16. A first pulley cable 24 is positioned about the first pulley 20 for movement relative thereto and a second pulley cable 26 is positioned about the second pulley 22 for movement relative thereto. The first pulley cable 24 includes a first end 28 and a second end 30 and the second pulley cable 26 includes a. first end 32 and a second end 34. A first handle 36 is coupled to the first end 28 of the first pulley cable 24 and a second handle 38 is coupled to the first end 32 of the second pulley cable 26. A body engaging assembly 40 is coupled to the both the second end 30 of the first pulley cable 24 and the second end 34 of the second pulley cable 26.

Figure 2:
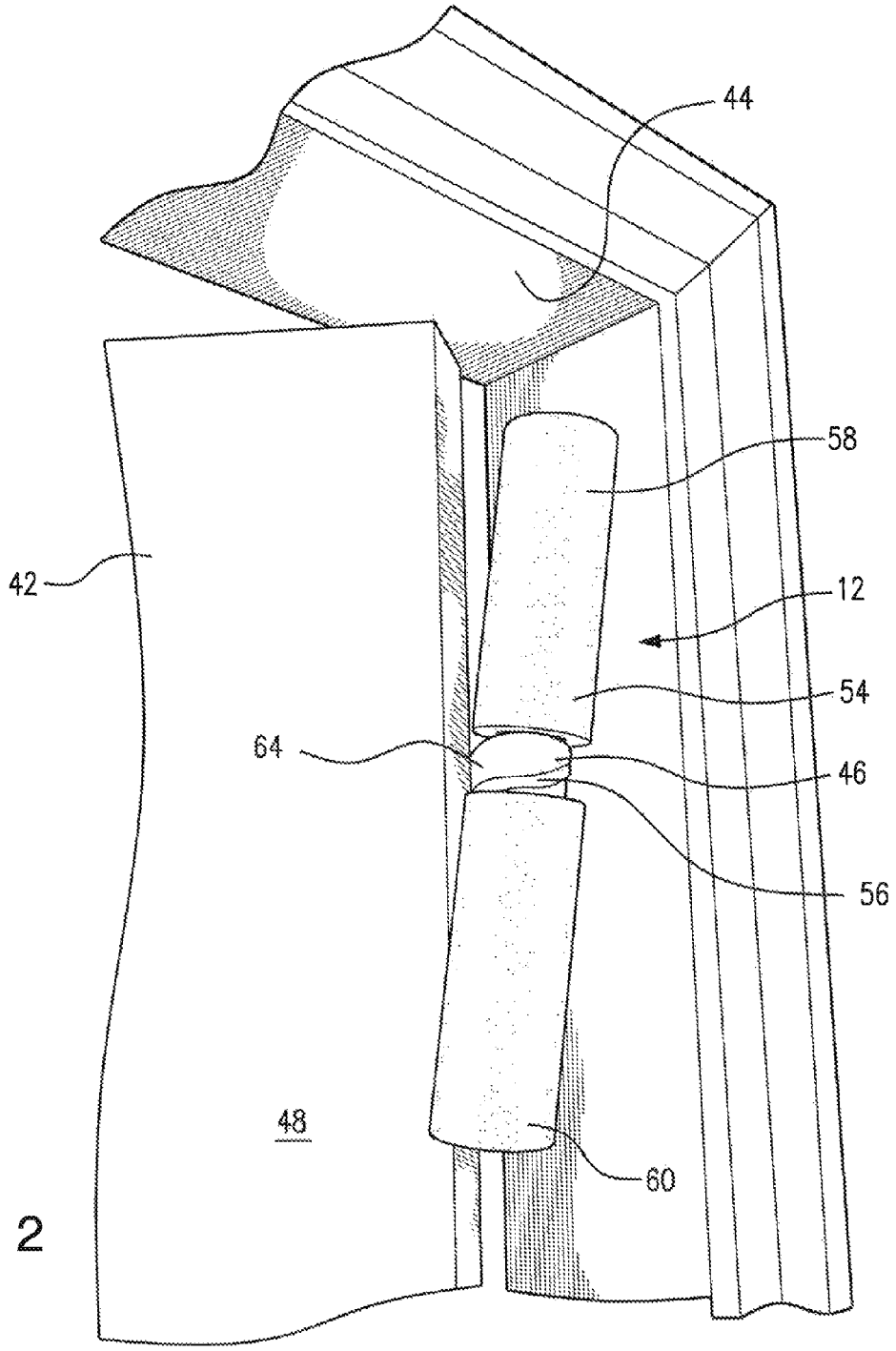
FIG. 2 is a detailed perspective view of the abutment member of the mounting assembly of the present exercise apparatus.
Figure 3:
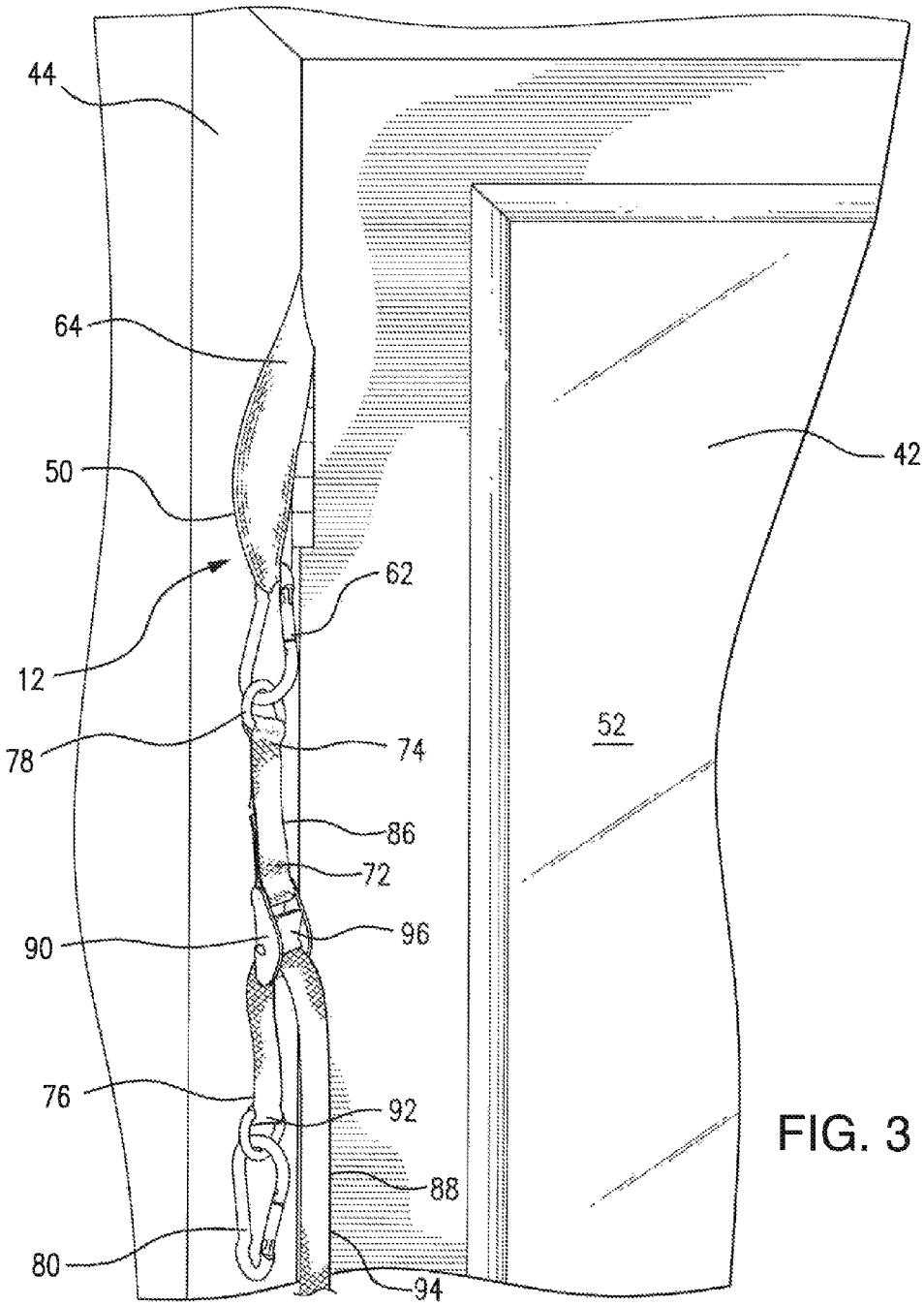
FIG. 3 is a detailed perspective view of the adjustable coupling strap used in securing the pulley assembly to the mounting assembly.

Referring now to FIGS. 1, 2 and 3, the mounting assembly 12 is adapted for selective attachment to a door 42 by positioning the mounting assembly 12 between the door 42 and the door frame 44 such that a first end 46 of the mounting assembly 12 is positioned on an exterior side 48 of the door 42 during exercise and a second end 50 of the mounting assembly 12 is positioned on an interior side 52 (that is, within the room where the user exercising) of the door 42 during exercise. The first end 46 is therefore provided with an abutment member 54 in the form of an elongated bar 56 having enlarged cushioned end members 58, 60 of a size such that the elongated bar 56 is too big to pass within the space between the door 42 and the door frame 44. The second end 50 of the mounting assembly 12 is provided with a releasable coupling member 62 in the form of a carbineer, which, as will be appreciated based upon the following disclosure, allows for selective attachment of the pulley assembly 14 to the mounting assembly 12. The releasable coupling member 62 at the second end 50 of the mounting assembly 12 is secured to the abutment member 54 at the first end 46 of the mounting assembly 12 by a strap 64 shaped and dimensioned to pass between the exterior side 48 of the door 42 and the interior side 52 of the door 42 with the strap 64 fitting within the space between the door 42 and the door frame 44.

Figure 4:
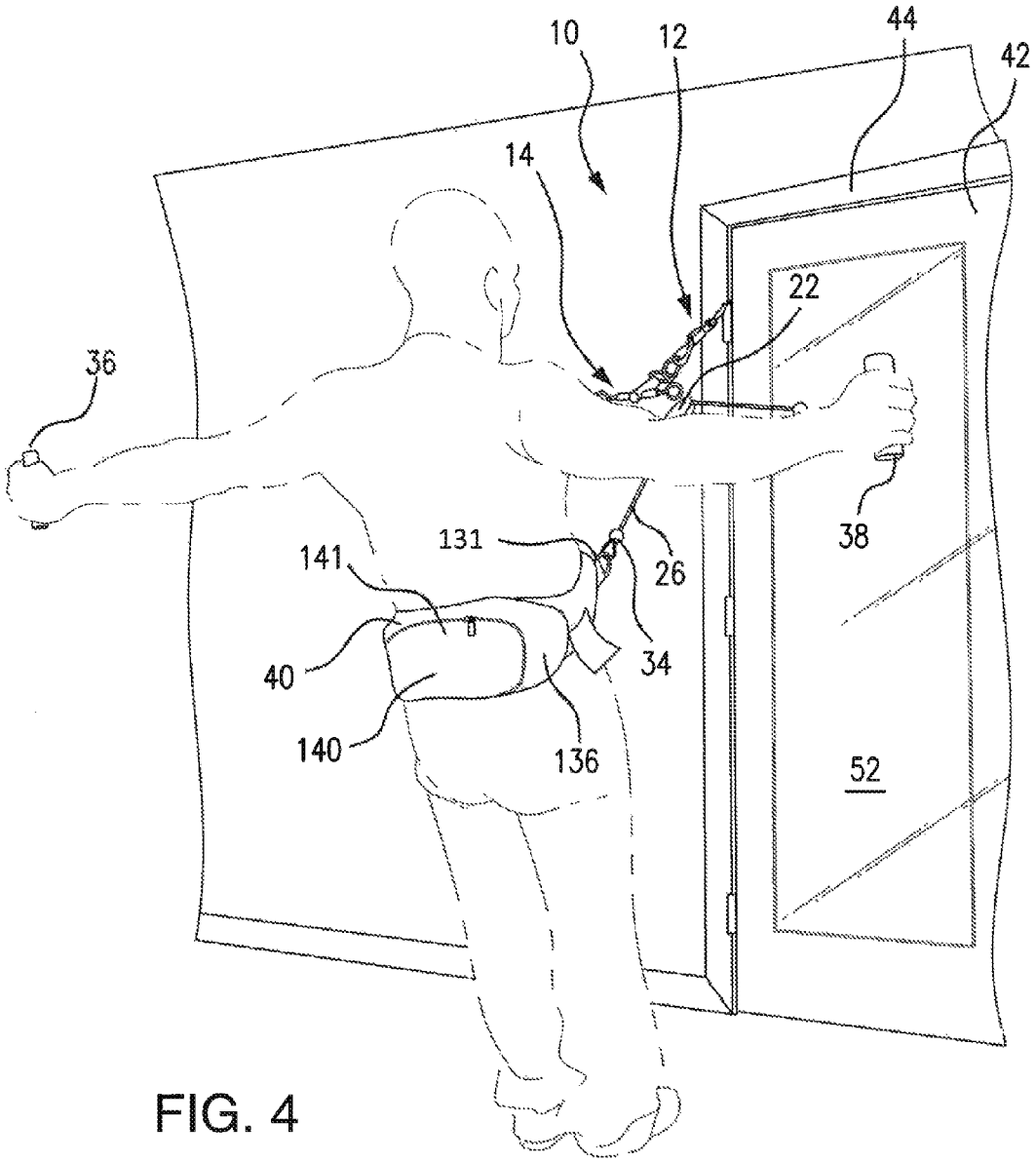
FIGS. 4 and 5 show the exercise apparatus in use.
Figure 5:
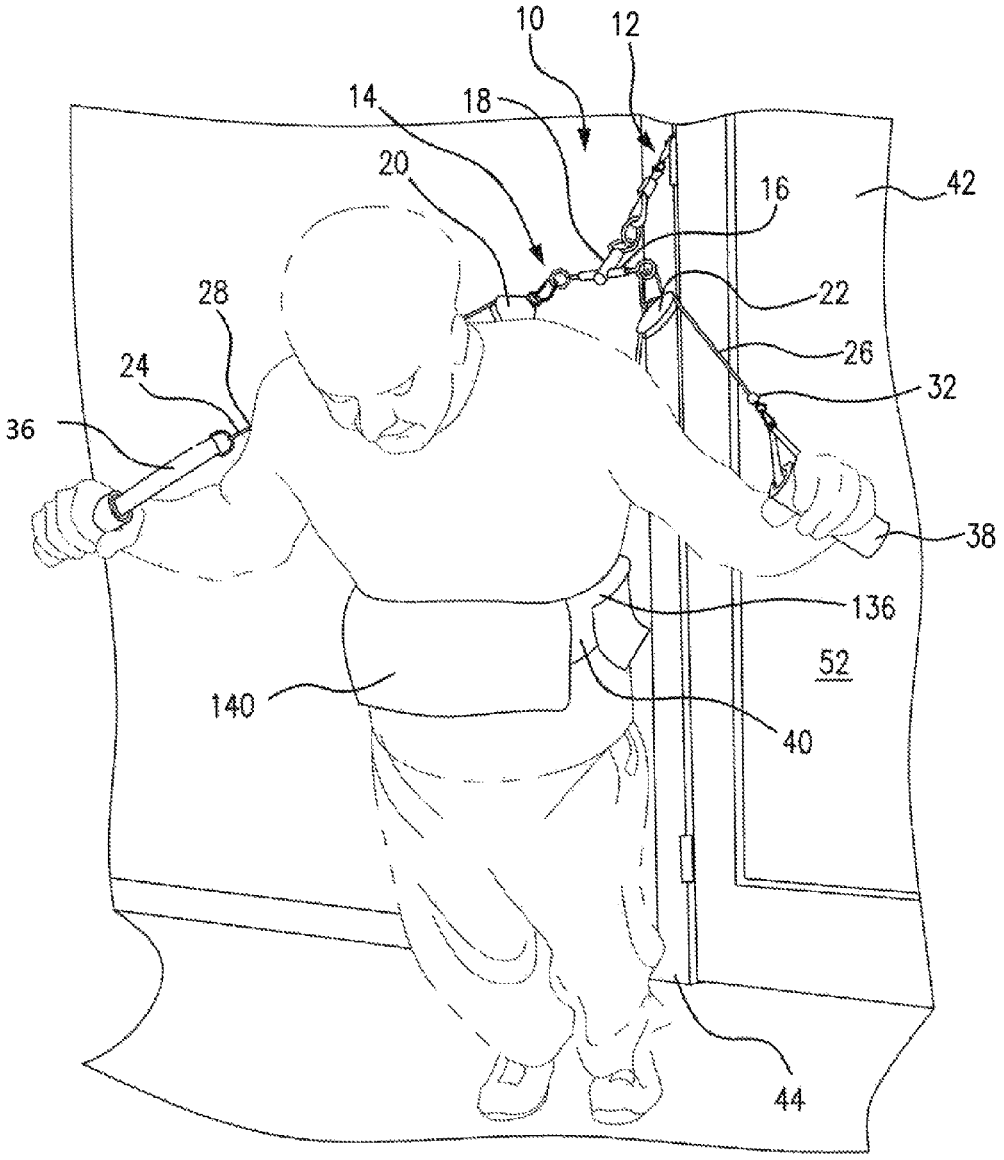
Figure 6:
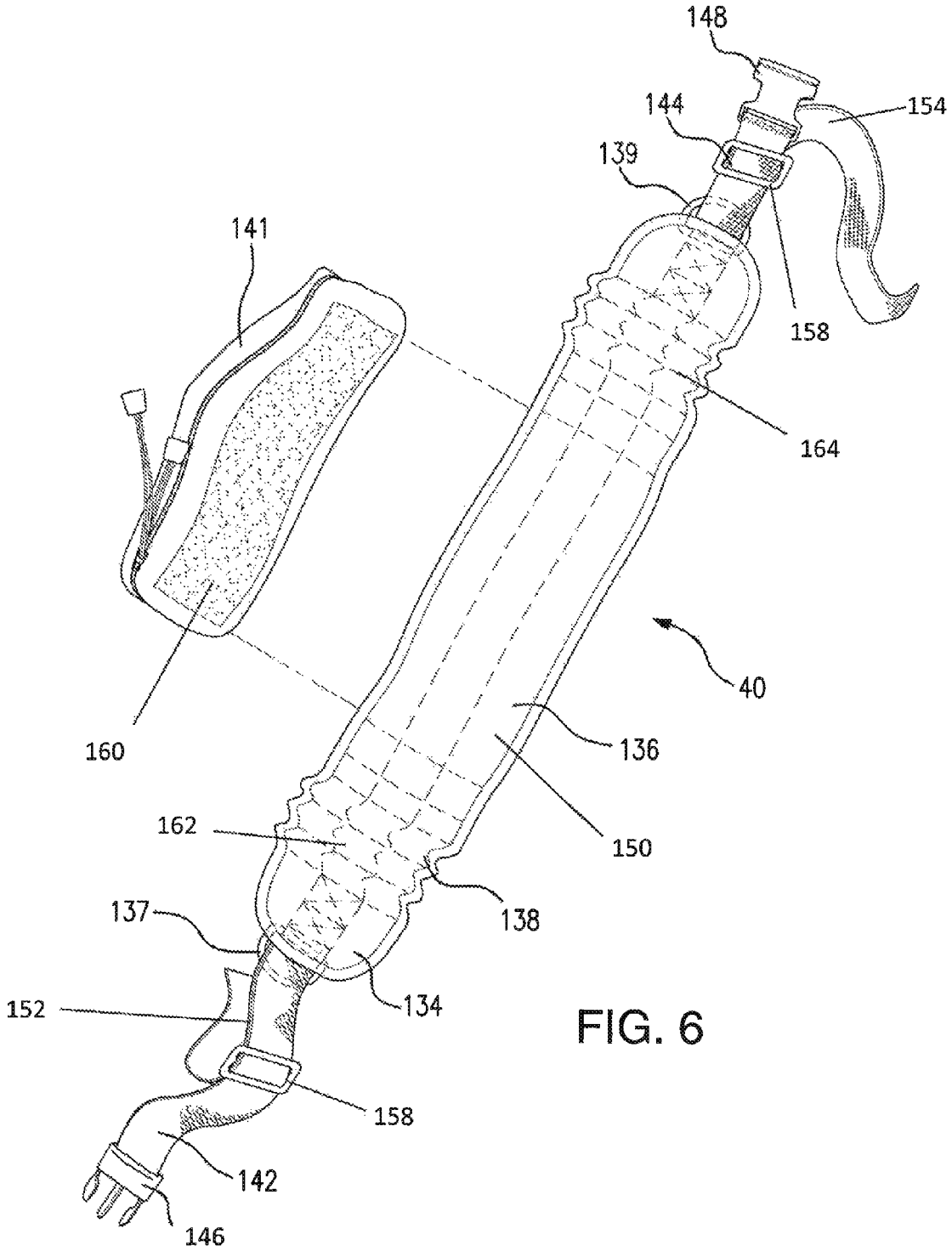
FIG. 6 is a perspective view of the belt used in conjunction with the present exercise apparatus.

Turning now to the pulley assembly 14 as shown best with reference to FIGS. 1, 4 and 5, the pulley assembly 14 includes a support bar 16 from which the coupling bar 18 and the first and second pulleys 20, 22 extend. The support bar 16 includes a first end 66 and second end 68, with a central section 70 between the first end 66 and the second end 6$. The coupling bar 18 is secured to the sup ort bar 16 at approximately the longitudinal center of the support bar 16 and extends in a direction perpendicular to the longitudinal axis of the support bar 16.

An adjustable coupling strap 72 is used in securing the pulley assembly 14 to the mounting assembly 12, in particular, in securing the pulley assembly 14 to the releasable coupling member 62 at the second end 30 of the mounting assembly 12. The adjustable coupling strap 72 includes a first end 74 and a second end 76. The first end 74 of the adjustable coupling strap 72 is provided with a coupling ring 78 (for example, an O-ring) shaped and dimensioned for selective attachment to the releasable coupling member 62 and the second end 76 of the coupling strap 72 is provided with a releasable coupling member 80 in the form of a carbineer that is shaped and dimensioned for selective coupling with an O-ring 82 at the free end 84 of the coupling bar 18. In this way, the adjustable coupling strap 72 may be selectively secured between the pulley assembly 14 and the mounting assembly 12 to secure the functional components of the present exercise apparatus 10 to the door 42.

As mentioned above, the coupling strap 72 is adjustable. In accordance with a preferred embodiment, this is achieved by forming the coupling strap 72 from two strap members 86, 88 with a buckle 90 positioned between. The first strap member 86, which forms the first end 74 of the coupling strap 72 is of a fixed length and is fixedly secured to the O-ring 78 and the buckle 90. The second strap member 88, which forms the second end 76 of the coupling strap 72 is of an adjustable operating length and passes through the buckle 90 for selective attachment thereto in a manner allowing for adjustment of the effective length of the adjustable coupling strap 72. The second strap member 88 includes a first end 92 to which the releasable coupling member 80 is secured and a free, second end 94. The second strap member 88 is moved and locked relative to the buckle 90 so as to adjust the length of the second strap member 88 extending between the buckle 90 and the releasable coupling member 80. It is appreciated the buckle 90 is a conventional spring based locking buckle using a pivoting and spring biased latching member 96 to control movement of the second strap member 88 relative to the buckle 90.

The pulley assembly 14 also includes a first pulley 20 and a second pulley 22 extending from the support bar 16. The first pulley 20 is secured to the first end 66 of the support bar 16 in a manner permitting a full range of motion of the first pulley 20 relative to the support bar 16. Similarly, the second pulley 22 is secured to the second end 68 of the support bar 16 in a manner permitting a full range of motion of the second pulley 22 relative to the support bar 16. A full range of motion, as well as releasable attachment of the first and second pulleys 20, 22 to the respective ends 66, 68 of the support bar 16, is achieved by providing the first end 66 and the second end 68 of the support bar 16 with first and second O-rings 98, 100. The first and second pulleys 20, 22 are secured to the O-rings 98, 100 using first and second releasable coupling members 102, 104, in particular, carbineers, from which the first and second pulleys 20, 22 extend.

Considering now the first and second pulleys 20, 22, they are conventional pulleys and may take various forms. In accordance with a preferred embodiment, each of the first and second pulleys 20, 22 include a U-shaped frame member 106, The U-shaped frame member 106 includes a first end 108 at the connection member 110 coupling the first and second arms 112, 114 at a second end 116 at the free ends of the first and second arms 112. The first end 103 includes an O-ring 118 to which the releasable coupling member 102, 104 is secured and the second end 116 includes a pivot pin 120 extending between the free ends of the first and second arms 112, 114 with a wheel 122 rotating upon the pivot pin 120.

As mentioned above, a first pulley cable 24 is secured to the first pulley 20 and a second pulley cable 26 is secured to the second pulley 22 With reference to the first pulley cable 24, it passes within the space defined by the U-shaped frame member 106 between the first end 108, which is closed by the connection member 110, and the second end 116, which is closed by the pivot pin 120 and wheel 122. The first pulley cable 24 is retained within the spaced defined by the U-shaped frame member 106 by securing a first locking hall 124 adjacent the first end 28 of the first pulley cable 24 and a second locking ball 126 adjacent the second end 30 of the first pulley cable 24. The first and second locking halls 124, 126 are larger than the space defined by the U-shaped frame member 106 and the respectively first and second ends 28, 30 of the first pulley cable 24 may not be pulled through the space defined by the U-shaped frame member 106 so as to effectively remove the first pulley cable 24 from the first pulley 20. Similarly, the second pulley cable 26 is retained within the spaced defined by the U-shaped frame member 106 by securing a first locking ball 128 adjacent the first end 32 of the second pulley cable and a second locking hall 131 adjacent the second end 34 of the second pulley cable 26. The first and second locking balls 128, 130 are larger than the space defined by the U-shaped frame member 106 and the respectively first and second ends 32, 34 of the second pulley cable 26 may not be pulled through the space defined by the U-shaped frame member 106 so as to effectively remove the first pulley cable 24 from the first pulley 20.

The first pulley cable 24 includes a first end 28 and second end 30. A first handle 36 is coupled to the first end 28 of the first pulley cable 24, at a position beyond the previously discussed first locking ball 124. The body engaging assembly 40 is coupled to the second end 30 of the first pulley cable 24 at a position beyond the previously discussed second locking ball 126. The first handle 36 and the body engaging assembly 40 are releasably secured to the first pulley cable 24. In accordance with a preferred embodiment the first and second ends 28, 30 of the first pulley cable 24, as well as the first handle 36 and the body engaging assembly 40 are provided with O-rings that are releasably connected together as described above using releasable coupling members 132, 133 in the form of carbineers. With regard to the second pulley cable 26, it includes a first end and second end 32, 34. The second handle 38 is coupled to the first end 32 of the second pulley cable 26, at a position beyond the previously discussed first locking ball 128. The body engaging assembly 40 is coupled to the second end 34 of the second pulley cable 26 at a position beyond the previously discussed second locking ball 130. The second handle 38 and the body engaging assembly 40 are releasably secured. to the first pulley cable 24. In accordance with a preferred embodiment the first and second ends 32, 34 of the second pulley cable 26, as well as the second handle 38 and the body engaging assembly 40 are provided with O-rings that are releasably connected together as described above using releasable coupling members 131, 135 in the form of carbineers. Further versatility may be achieved through the provision of gripping balls formed adjacent the first ends of the first and second pulley cables. These gripping balls would allow for exercises where handles are not optimal and permit a user to grip the first end of the respective first and second pulley cables at positions slightly displaced from the actual ends of the cables where a shorter effective cable length is desired.

Considering now the body engaging assembly 40 it is preferably a belt 134 shaped and dimensioned for positioning about the waste of a user as he or she exercisers. As such, the belt 134 includes an elongated body 136 with an inner surface 138 and an outer surface 140, as well as a first end 142 and a second end 144. The respective first end 142 and second end 144 are provided with mating fastening members 146, 148 allowing for releasable attachment of the belt 134 about the waist of a user. The belt 134 is primarily composed of a central wide strap member 150 from which adjustable straps 152, 154 (using conventional buckles 158 to allow for adjustment) extend at both the first end 142 of the belt 134 and the second end 144 of the belt 134. In accordance with a preferred embodiment the ends of the wide strap member 150 are provided with elastic allowing for stretching of the wide strap member 150 to accommodate various body positions for different exercises, as well as various body sizes without the need for the larger scale adjustments permitted. by the adjustable straps 152, 154

With regard to the attachment of the second ends 30, 34 of the first and second pulley cables 26, 28 to the elongated. body 136 of the body engaging assembly 40, the elongated body 136 is constructed such that the O-rings 137, 139 used in securing the second ends 30, 34 of the first and second pulley cables 24, 26 to the elongated body 136 are positioned along the outer surface 140 of the elongated body 136, that is, the surface of the elongated body 136 facing away from the user when the body engaging assembly 40 is properly positioned about the waste of the user.

More particularly, the O-rings 137, 139 are positioned such that they are substantially aligned with opposed side of the body along front plane of the user's body; that is, the O-rings, 137, 139, when the belt 1.34 is properly secured about the user will be positioned at the left and right sides of the body As will be further appreciate when the variety of uses for the present exercise apparatus is explained below, and as discussed above, the belt 134 includes an elastic feature allowing for positioning of the belt 134 at various locations along the abdomen and torso of the user. In particular, the belt 134 includes a left side panel 162 adjacent the first end of belt 134 and a right side panel 164 adjacent the second end of the belt 134. Each of the first side panel and the right side panel is provided with an elastic member allowing for controlled expansion thereof. In addition, it is appreciated additional. security can be achieved by extending a tether from the mounting assembly 40 to the belt 134.

In use, the present exercise may be thought of as "a gym in a bag." In particular, the body engaging assembly 40 is provided with a zippered pouch 141 in which the various functional components of the present exercise apparatus 10 may be stored, In accordance with a preferred embodiment, the pouch 141 is secured to the belt 134 using hook and loop fasteners 160 allowing for selective attachment thereto.

When it is time to exercise, the user removed the various functional components, that is, the mounting assembly 12 and the pulley assembly 14. The abutment member 54 is positioned the exterior side of the door 42 and the strap 64 is slid between the door 42 and the door frame 44. In particular, the strap 64 is slid between the door 42 and the door frame 44 from the top of the door 42 such that the strap 64 sits upon the upper hinge connecting the door 42 to the door frame 44.

With the abutment member 54 positioned on the exterior of the door 42 and the strap 64 extending to the interior of the door 42, the adjustable coupling strap 72 is secured to the strap 64 and the pulley assembly 14 is secured to the adjustable coupling strap 72. The user then secures the body engaging assembly about his or her torso or waist depending upon the exercise. The second ends 30 of the pulley cables are then secured to the attachment points of the body engaging assembly 40. At this point, the user may adjust the adjustable coupling strap 72 to suit the specific exercise he or she plans to perform. In particular, the adjustable coupling strap 72 is adjusted such. that the user may use his or her complete weight from the ground up, meaning that you will lift your whole weight from the ground up, but spreading the load all over your body. Thereafter, the user may grip the handles and begin exercising.

As a result, the user becomes the weight and can either lean forward or backward while performing various exercises, For example, the present exercising apparatus will allow you to do back, squats, shoulders, biceps, triceps etc. with your body functioning as the resistance weight.

In the case where you desire to do a chest workout, you may lean forward with the belt 134 positioned at a comfortable position as shown in FIG. 5. When you are doing butterflies or you're doing push-ups or shoulders you can lean, you can go down and come up in one motion using your whole body. Because you're at an angle, your body has to flex all its front muscles to keep you straight up. You can do back exercises, upper chest exercises, lower chest exercises, sit-ups etc.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. An exercise apparatus allowing a user to perform a variety of exercises with the user's body functioning as a resistance weight, comprising:

a mounting assembly;

a pulley assembly coupled to the mounting assembly, wherein the pulley assembly includes a support bar having a first end with a first pulley secured thereto and a second end with a second pulley secured thereto, the pulley assembly also including a coupling bar extending from the support bar for releasably securing the pulley assembly to the mounting assembly by securing a coupling strap therebetween;

a first pulley cable is positioned about the first pulley for movement relative thereto and a second pulley cable is positioned about the second pulley for movement relative thereto, the first pulley cable includes a first end and a second end and the second pulley cable includes a first end and a second end;

a first handle is directly coupled to the first end of the first pulley cable and a second handle is directly coupled to the first end of the second pulley cable; and a body engaging assembly is directly coupled to the both the second end of the first pulley cable and the second end of the second pulley cable.

2. The exercise apparatus according to claim 1, wherein the first end of the support bar includes a first O-ring to which the first pulley is secured and a second O-ring to which the second pulley is secured.

3. The exercise apparatus according to claim 2, wherein the first pulley is releasably secured to the first O-ring and the second pulley is releasably secured to the second O-ring.

4. The exercise apparatus according to claim 1, wherein the mounting assembly includes a first end and a second end, wherein the first end of the mounting assembly includes an abutment member and the second end of the mounting assembly includes a releasable coupling member allowing for selective attachment of the pulley assembly to the mounting assembly.

5. The exercise apparatus according to claim 4, wherein the releasable coupling member of the mounting assembly is a carbineer.

6. The exercise apparatus according to claim 1, further including an adjustable coupling strap securing the pulley assembly to the mounting assembly.

7. The exercise apparatus according to claim 1, wherein the first handle is releasably coupled to the first end of the first pulley cable and the second handle is releasably coupled to the first end of the second pulley cable.

8. The exercise apparatus according to claim 1, wherein the body engaging assembly is a belt shaped and dimensioned for positioning about a waist of a user as he or she exercisers.

9. The exercise apparatus according to claim 8, wherein the belt includes an elongated body with an inner surface and an outer surface, as well as a first end and a second end, and the respective first end of the elongated body and the second end of the elongated body are provided with mating fastening members allowing for releasable attachment of the belt about the waist of a user.

10. The exercise apparatus according to claim 9, wherein the belt includes first and second O-rings used in releasably securing the second ends of the first and second pulley cables to the elongated body.

11. The exercise apparatus according to claim 10, wherein the first and second O-rings are positioned along the outer surface of the elongated body.

12. The exercise apparatus according to claim 1, wherein the first pulley cable includes first and second locking balls so as to maintain the first pulley cable positioned about the first pulley, the first locking ball of the first pulley cable being adjacent the first end of the first pulley cable and the second locking boll being adjacent the second end of the first pulley cable, and the second pulley cables includes first and second locking balls so as to maintain the second pulley cable positioned about the second pulley, the first locking ball of the second pulley cable being adjacent the first end of the second pulley cable and the second locking ball being adjacent the second end of the second pulley cable.

* * * * *